US010278518B2

(12) United States Patent
Xie

(10) Patent No.: US 10,278,518 B2
(45) Date of Patent: May 7, 2019

(54) DISPLAY APPARATUS AND CONTROL METHOD THEREOF

(71) Applicant: ALLPOWER DISPLAY CO., LTD., Dongguan (CN)

(72) Inventor: Guangqin Xie, Dongguan (CN)

(73) Assignee: ALLPOWER DISPLAY CO., LTD., Dongguan (CN)

( * ) Notice: Subject to any disclaimer, the term of this patent is extended or adjusted under 35 U.S.C. 154(b) by 0 days.

(21) Appl. No.: 15/712,088

(22) Filed: Sep. 21, 2017

(65) Prior Publication Data

US 2019/0008288 A1 Jan. 10, 2019

(30) Foreign Application Priority Data

Jul. 6, 2017 (CN) ..... 2017 1 0545826

(51) Int. Cl.

| | |
|---|---|
| ***A47F 3/00*** | (2006.01) |
| ***A47F 7/02*** | (2006.01) |
| ***A47F 3/12*** | (2006.01) |
| ***A47F 3/04*** | (2006.01) |
| ***A47F 3/14*** | (2006.01) |
| ***F25D 29/00*** | (2006.01) |

(52) U.S. Cl.

CPC ..... *A47F 3/007* (2013.01); *A47F 3/005* (2013.01); *A47F 3/0434* (2013.01); *A47F 3/0478* (2013.01); *A47F 3/12* (2013.01); *A47F 3/142* (2013.01); *A47F 7/02* (2013.01); *F25D 29/003* (2013.01)

(58) Field of Classification Search

CPC .. A47F 7/02; A47F 3/007; A47F 3/005; A47F 3/0434; A47F 3/0478; A47F 3/12; A47F 3/142; F25D 29/003

See application file for complete search history.

(56) References Cited

U.S. PATENT DOCUMENTS

| | | | | |
|---|---|---|---|---|
| 2,584,869 A * | 2/1952 | Gunder | A47F 3/005 312/114 |
| 3,316,041 A * | 4/1967 | Nelson | A47F 3/005 220/665 |
| 5,165,768 A * | 11/1992 | Zarrabi | A47F 3/002 109/54 |
| 6,540,311 B2 * | 4/2003 | Canedy | A47F 3/002 108/147 |
| 6,764,145 B2 * | 7/2004 | Canedy | A47F 3/002 312/114 |
| 6,851,770 B2 * | 2/2005 | Canedy | A47F 3/002 312/114 |
| 7,905,560 B2 * | 3/2011 | Vardaro | A47F 3/002 312/137 |
| 8,047,619 B2 * | 11/2011 | Amstutz | A47F 3/002 312/117 |
| 2007/0194674 A1 * | 8/2007 | Salter | A47B 51/00 312/312 |

* cited by examiner

*Primary Examiner* — Hanh V Tran

(57) ABSTRACT

A display apparatus comprises a locker, at least one display cabinet, and a PLC system. The PLC system controls a display product transmitted between the locker and the at least one display cabinet, and when the at least one display cabinet is destroyed, the PLC controls the display product transmitted to the locker from the locker.

14 Claims, 13 Drawing Sheets

DISPLAY APPARATUS AND CONTROL METHOD THEREOF

CROSS REFERENCE TO RELATED APPLICATIONS

This application claims priority to Chinese Patent Application No. 201710545826.X, filed Jul. 6, 2017, which is hereby incorporated by reference herein as if set forth in its entirety.

BACKGROUND

1. Technical Field

The present disclosure generally relates to display cabinet technology, and particularly to a display cabinet and a control method of the display cabinet.

2. Description of Related Art

A display cabinet is a display platform with protection function for displaying a plurality of products. The display cabinet is widely used in a company showroom, an exhibition, an advertisement to display handicrafts, gifts, jewelry, mobile phones, glasses, clocks, tobacco, drinks, and cosmetics. The display cabinet is commonly protected by a glass, visitors cannot see the display products very well and which is not easy to take pictures for the visitors. And most display cabinets only have alarming function, if the display cabinet is destroyed, the display products hi the display cabinet can be stolen.

Therefore, a need exists in the industry to overcome the described problems.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present, embodiments. Moreover, in the drawings, all the views are schematic, and like reference numerals designate corresponding parts throughout the several views.

DETAILED DESCRIPTION

Figure 1:
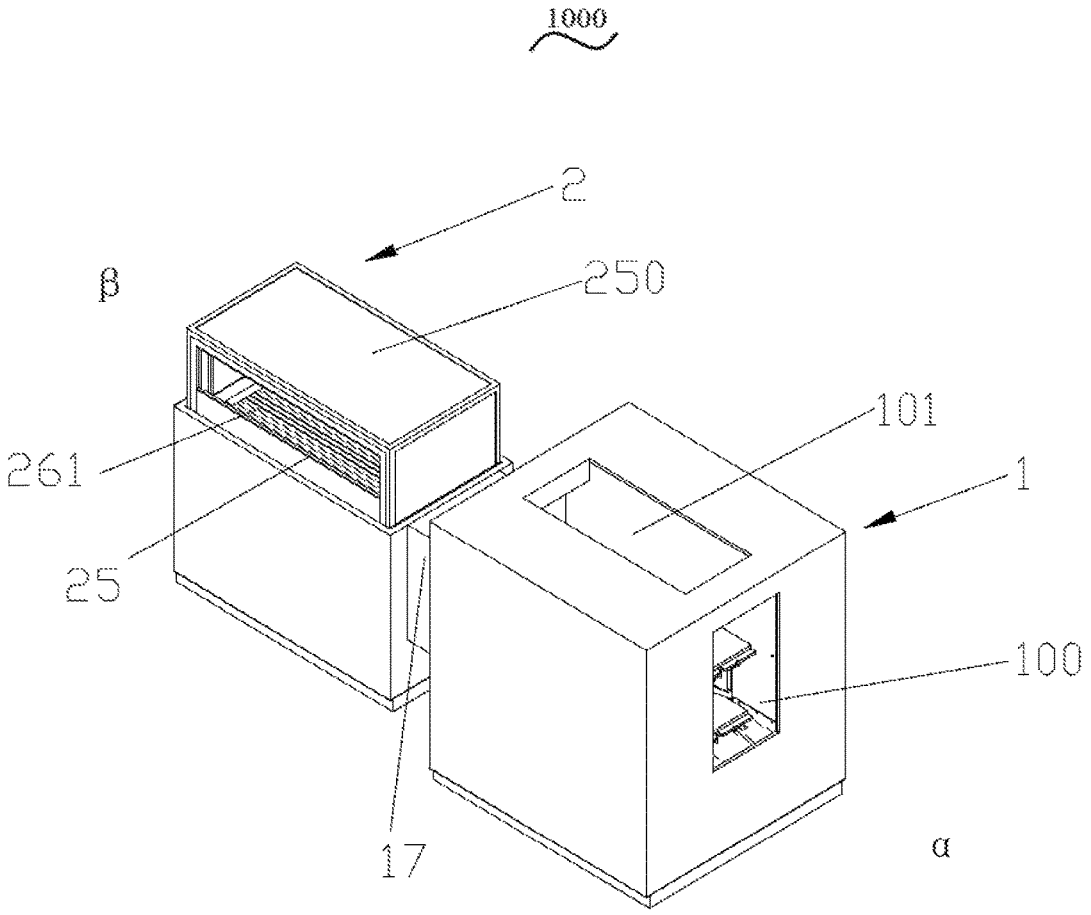
FIG. 1 is a schematic view of a display apparatus according to one embodiment.

The disclosure is illustrated by way of example and sot by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

First Embodiment

Referring to FIGS. 1-9, a display apparatus 1000 in present, disclosure is provided. The display apparatus 1000 is an automatic back library, anti-theft, anti-destruction display apparatus. The display apparatus 1000 can be coupled to a mobile terminal, such as, a tablet, a smart phone, a notebook. The display apparatus 1000 can include a locker 1, a PLC system, and a display cabinet 2.

The locker 1 can include a locker body 10, a first transmission structure 11, a first lifting telescopic structure 12, and a supporting board. A first opening is defined in a left side of the locker body 10; a second opening is defined in a right side of the locker body 10 opposite to the left side. As shown in FIG. 1, the side is labeled as α, the left side is labeled as β. A third opening 101 is defined in an upper side of the locker body 10. The first transmission structure 11 is received in the locker body 10 and located between the first opening and the second opening. The first lifting telescopic structure 12 is mounted in the locker body 10 and located on the first transmission structure 11. The supporting board 13 is mounted on the first lifting telescopic structure 12. In the embodiment, the locker 2 can include two supporting boards 13.

The display cabinet 2 can include a display cabinet body 20, a second transmission structure 21, and a second lifting telescopic structure 22. A fourth opening 23 is defined in the display cabinet body 20 corresponding to the first opening. A fifth opening 25 is defined in an upper side of the display cabinet body 20. An anti-destruction transparent display window 250 is arranged on the fifth opening 25. The second transmission structure 21 is received in the display cabinet body 20. The second lifting telescopic structure 22 is mounted in the display cabinet body 20 and located on the second transmission structure 21.

A rail 3 is arranged to connect the first transmission structure 11 and the second transmission structure 21 between the fourth opening 23 and first opening.

The PLC system is arranged in the locker 1. The PLC system is in control connection with the first transmission structure 11, the first lifting telescopic structure 12, the second transmission structure and the second lifting telescopic structure 22.

In the embodiment, the control connection denotes that the first transmission structure 11, the second transmission structure 12, the first lifting telescopic structure 21 and the second lifting telescopic structure 22 are controlled by a control program of the PLC system. In the embodiment, the PLC system is controlled by the mobile terminal via a wireless signal. When a display product is placed on the supporting board 13, the PLC system controls the first lifting telescopic structure 12 to move along a vertical direction, the supporting board 13 is moved to the first transmission structure 11. And then the first transmission structure 11 transmits the supporting board 13 to the rail 3 between the first opening and the fourth opening 23. Further, the supporting board 13 is transmitted to the second transmission structure 21 of the display cabinet 2 via the rail. The second transmission structure 21 is configured to transmit the display product into a next display cabinet 2, temporarily store the display product, or pass the display product to the locker 1. When the display product is temporarily stored in the second transmission structure 21, the second lifting telescopic structure 22 lifts the display product on the supporting board 13 to the fifth opening 25, thus the visitors can see the display product via the display window 250. In the embodiment, a number of the supporting board 13 is greater than a number of the display cabinet 2, the idle display products can be placed on the supporting board 13.

Figure 2:
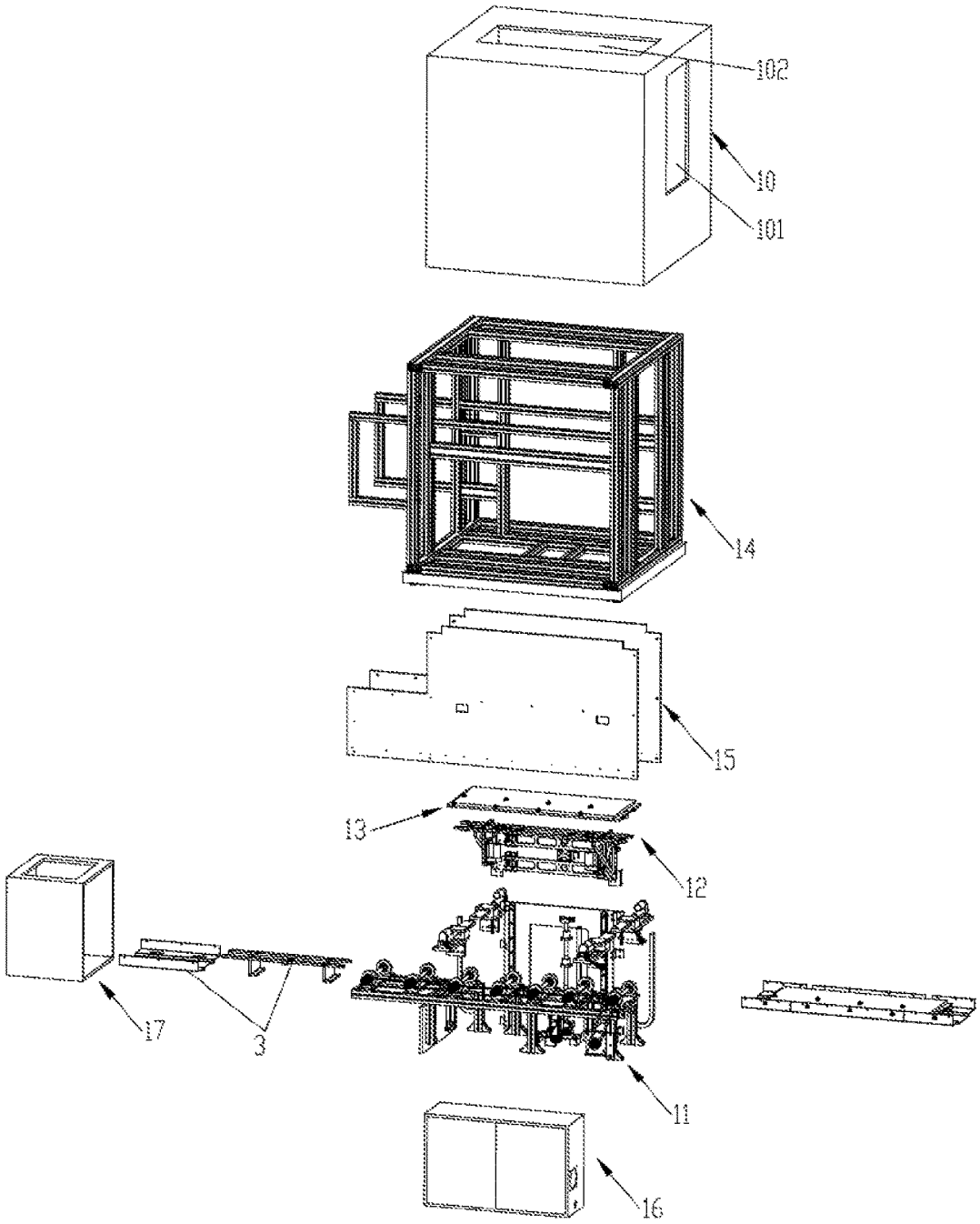
FIG. 2 is a schematic view of a locker of the display cabinet of FIG. 1.

Referring to FIG. 2, the locker 2 can further include a locker bracket 14, a wall board 15, an electrical cabinet 16, a wall through interface 17. The locker 14 is mounted in the locker body 10. The wall board 15 is mounted in a front and back side of the locker bracket 14 to fix the first transmission structure 11 and the first lilting telescopic structure 12. The electrical cabinet 16 is mounted in the locker bracket 14. The PLC system is arranged in the electrical cabinet 16.

The locker bracket 14 and the wall board 15 make the electrical cabinet 16, the first transmission structure 11, and the first lifting telescopic structure 12 compactly received in the locker body 10. In the embodiment, the electrical cabinet 16 supplies power for the first transmission structure 11 and the first lifting telescopic structure 12. The wall through interface 3 is configured to receive the rail. In the embodiment the locker 1 is located in one side of the wall, and the display cabinet 2 is located in the other side of the wall.

Figure 3:
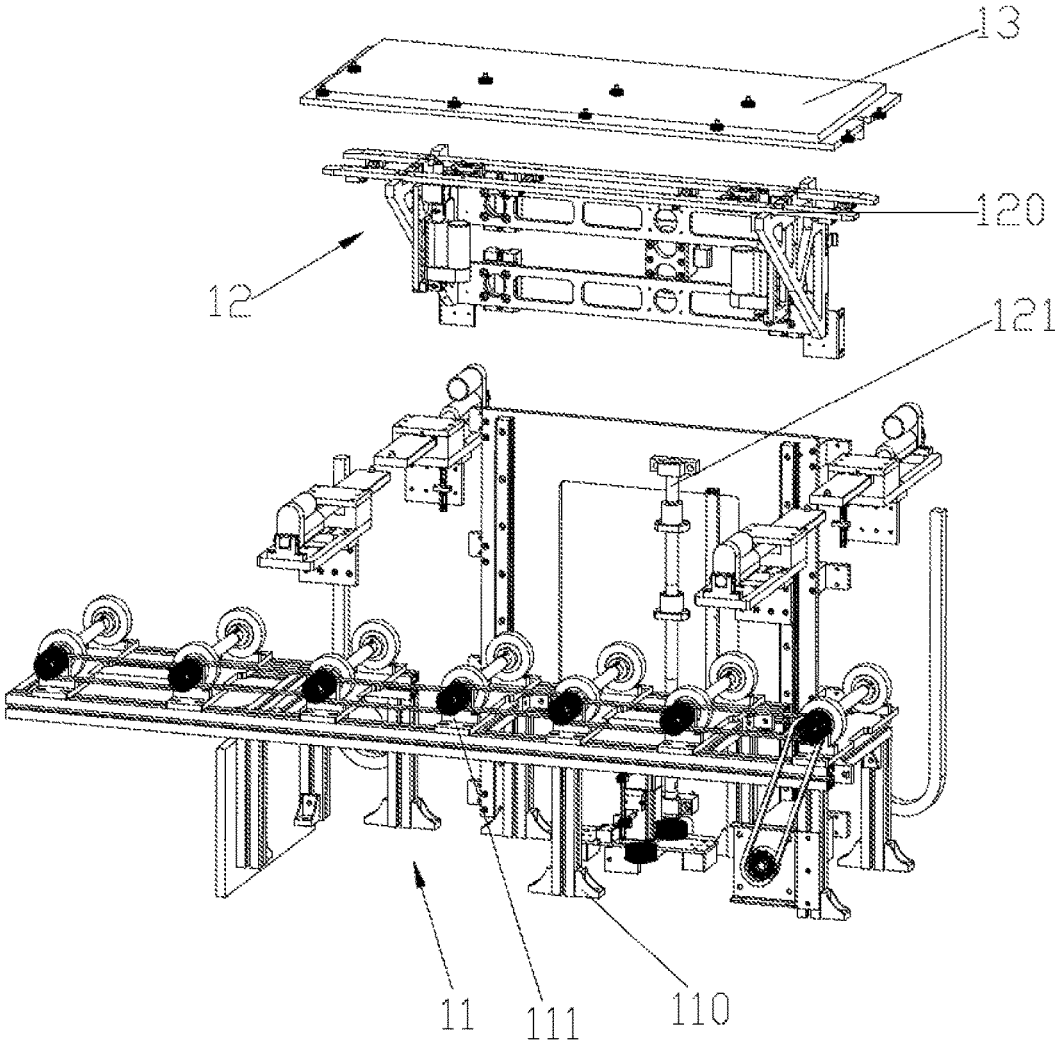
FIG. 3 is a schematic view of a first transmission structure and a first lifting telescopic structure of the locker, of FIG. 2.

Referring to FIG. 3, the first transmission structure 11 can include a first transmission bracket 110 and a first roller drive assembly 111. The first roller drive assembly 111 is mounted on the first transmission bracket 110. The first lifting telescopic structure 12 includes a first telescopic bracket 120 and a first electrical lifting assembly 121. The first telescopic bracket 120 is mounted on the first electrical lifting assembly 121 and driven to move upward or downward by the first electrical lifting assembly 121. The supporting board 13 is mounted on the first telescopic bracket 120.

The first electrical lifting assembly 121 controls the first telescopic bracket 120 with the supporting board 13 move upward or downward along the vertical direction. When the supporting board 13 moves to an upper side of the transmission structure 11, the first telescopic bracket 120 draws back away from the first transmission structure 11, and the supporting board 13 separates from the first telescopic bracket 120 to move to the first roller drive assembly 111. Then the supporting board 13 is transmitted by the first roller drive assembly 111.

Figure 6:
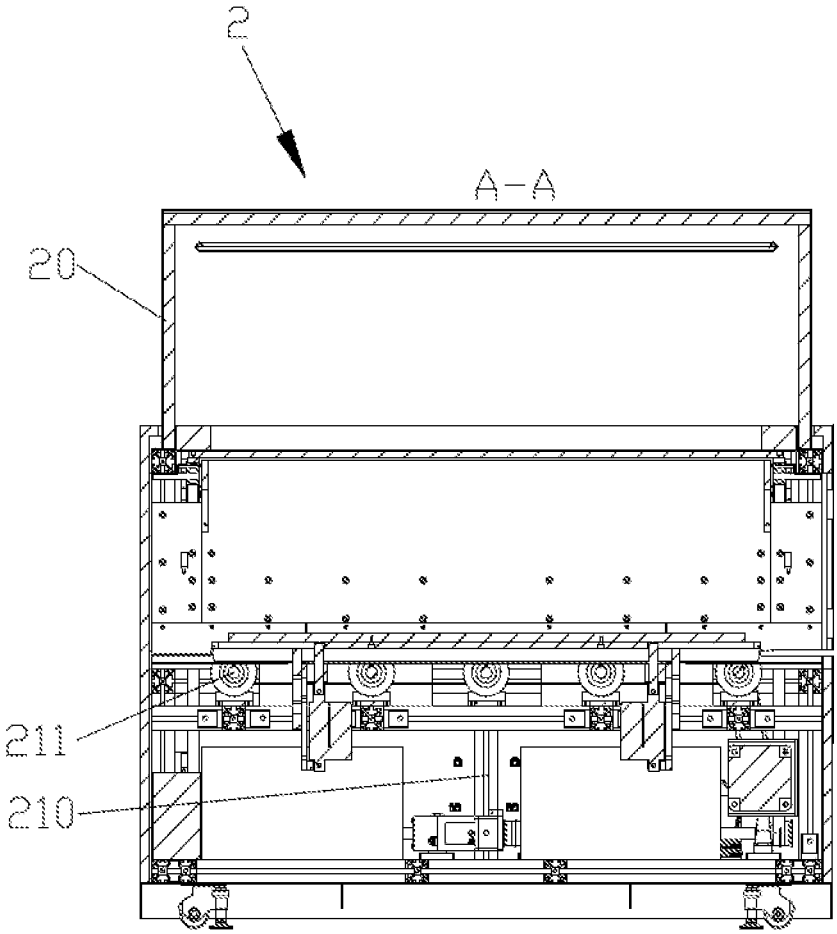
FIG. 6 is a section view of the display cabinet along line A-A.

Referring to FIG. 6, the display cabinet 2 can further include a display bracket, an LED bracket, a load plate, a glass lifting structure 27, a shutter lifting structure 26, and an alarming system. The display bracket is mounted in the display cabinet body 20. The LED bracket is mounted in the display window 250. The load plate is mounted in a lower side of the display cabinet body 20. An omni-directional wheel is arranged under the load plate. The second transmission structure 21 is mounted in the display bracket. The second lifting telescopic structure 22 is mounted in the display bracket and located on the second transmission structure 21. The shutter lifting structure 26 is vertically mounted on the second transmission structure 21 and the display bracket. The glass lilting structure 27 is mounted in a front side between the display cabinet body 20 and the second lifting telescopic structure 22.

A plurality of LEDs are arranged on the LED bracket to light the display product. The glass lifting structure 27 and the shutter lifting structure 26 are configured to protect the display product. When the display cabinet 1 is destroyed, the alarming system generates a vibration and a ring and the PLC system receives an alarming signal. The supporting board 13 with the display product is passed back to the locker by the second transmission structure 21 and the second lifting telescopic structure 22 under a control of the PLC system.

Figure 7:
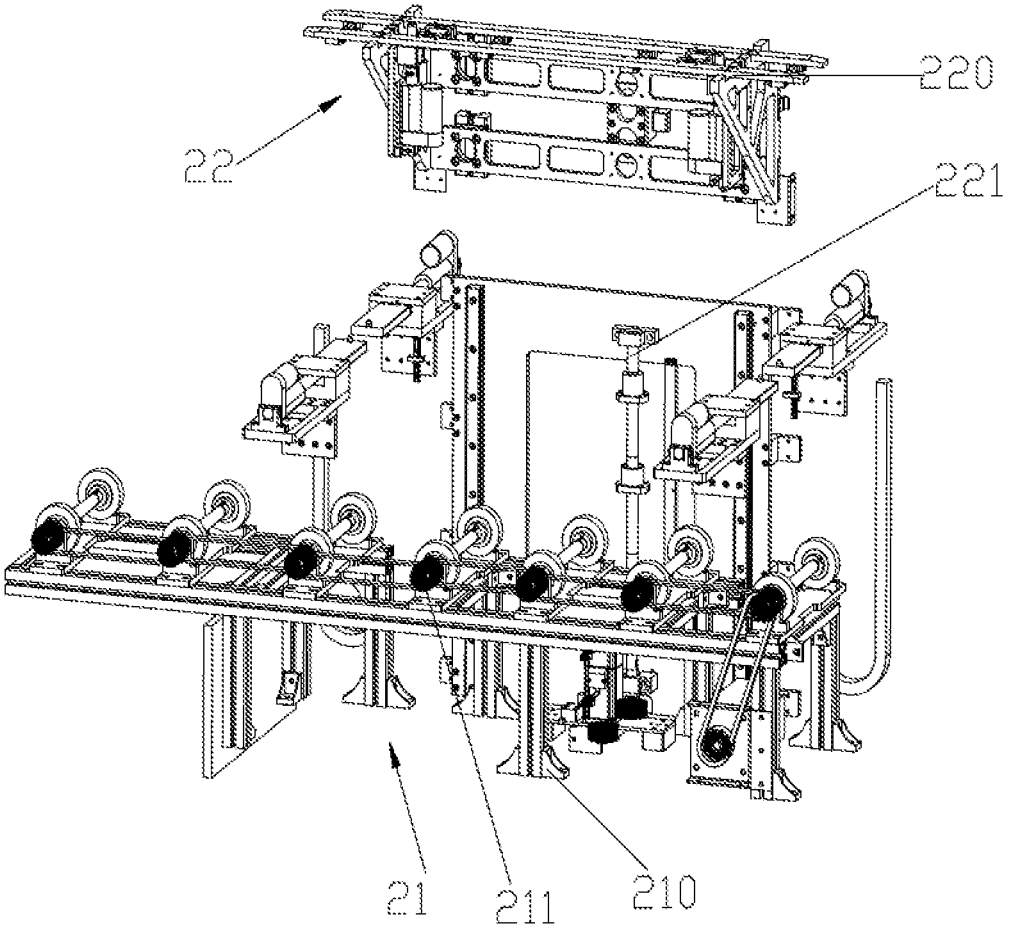
FIG. 7 is a schematic view of a second transmission structure and a second lifting telescopic structure of the display cabinet of FIG. 4.

Referring to FIG. 7, the second transmission structure 21 can include a second transmission bracket 210, a second roller drive assembly 211. The roller drive assembly 211 is mounted on the second transmission bracket 210. The second lifting telescopic structure 22 can include a second telescopic bracket 220 and a second electrical lifting assembly 221. The second telescopic bracket 220 is mounted on the second electrical lifting assembly 221 and driven by the second electrical lifting assembly 221 upward and downward along the vertical direction.

When the display product is transmitted to the second roller drive assembly 211 via the display cabinet 2 or last locker 1, the second electrical lifting assembly 221 controls the telescopic bracket 220 move upward and downward along the vertical direction. When the second telescopic bracket 220 is driven to close the second roller driver assembly 211, the second telescopic bracket 220 extends from a side near the first roller drive assembly 111. At this time, the supporting board 13 separates from the first roller drive assembly 111 to locate on the second telescopic bracket and is lifted to the fifth opening 25 by the second electrical lifting assembly 221.

Figure 8:
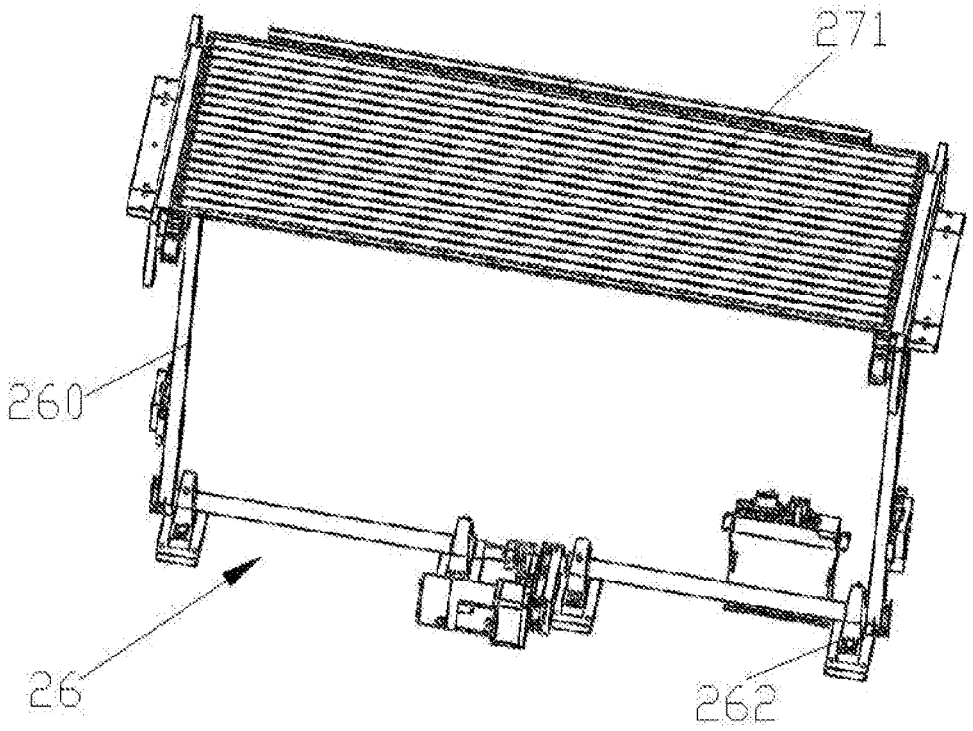
FIG. 8 a schematic view of a shatter lifting structure of the display cabinet of FIG. 4.

Referring to FIG. 8, the shatter lifting structure 26 can include a first fixing bracket 260, a shutter door 261, and an electrical pulley block 262. The shutter door 261 is mounted on the fixing bracket 260. The electrical pulley block 262 is coupled with the shutter door 261 via the first fixing bracket 260.

When the display cabinet 2 is not displayed, the shutter door 261 is driven to close the fifth opening 25 under a control of the electrical pulley block 262. When the display cabinet 2 is displayed, the shutter door 261 is driven to open the fifth opening 25 under the control of the electrical pulley block 262.

Figure 9:
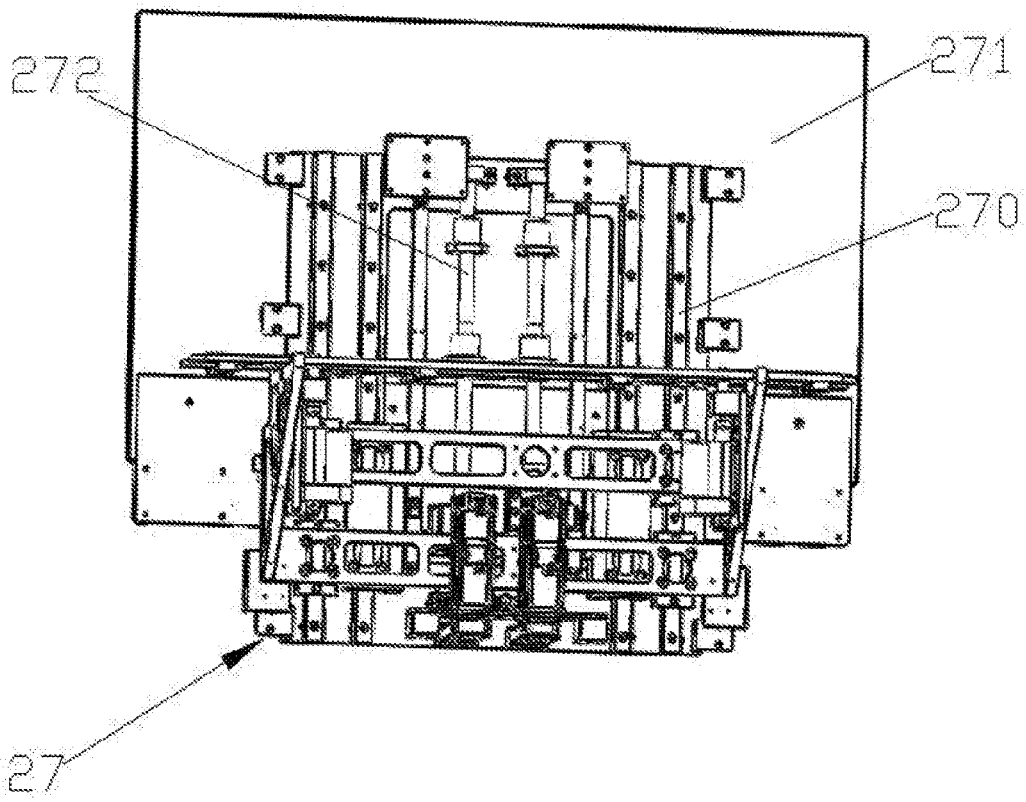
FIG. 9 is a schematic view of a glass lifting structure of the display cabinet of FIG. 4.

Referring to FIG. 9, the glass lifting structure 27 can include a second fixing bracket 270, a third electrical lifting assembly 272, and a glass. The third electrical lifting assembly 272 is mounted on the second fixing bracket 270. The glass 271 is mounted on the third electrical lifting assembly 272.

Second Embodiment

Figure 10:
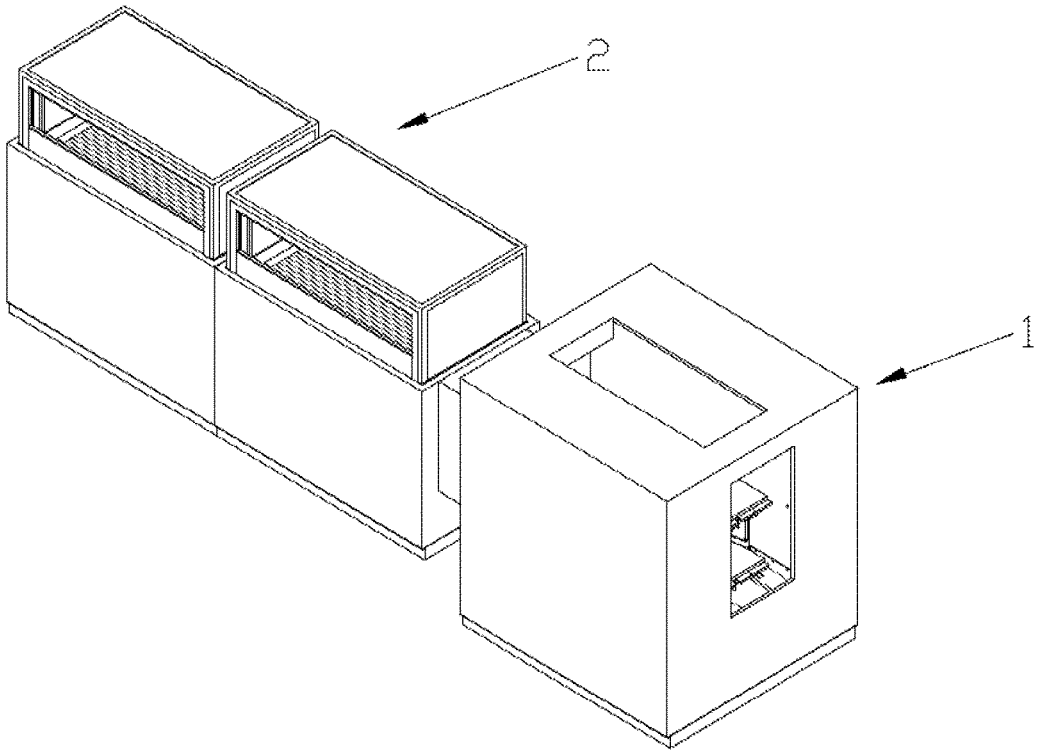
FIG. 10 is a schematic view of a display cabinet according to another embodiment.
Figure 11:
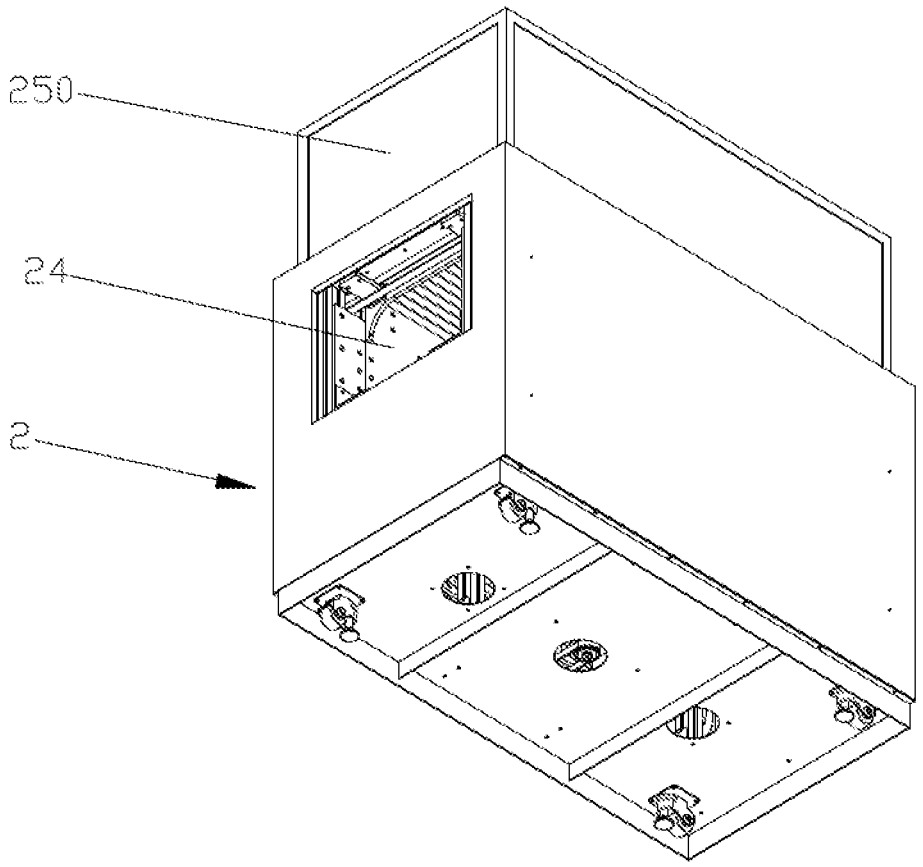
FIG. 11 is a schematic view between a locker and a display cabinet of the display cabinet of FIG. 10.

Referring to FIGS. 10-11, a display apparatus is provided in the present disclosure. The display apparatus is an automatic back library, anti-theft, anti-destruction display apparatus. The display apparatus can include a locker 1 and two display cabinets 2. A left side of a display cabinet 2 located between the locker 1 and the last display cabinet 2 defines a sixth opening 24 corresponding to the fourth opening 23. An internal structure of the locker 1 and display cabinet 2 of the second embodiment is similar to the internal structure of the locker 1 and the display cabinet 2 of the first embodiment.

When a number of the display cabinet 2 is greater than two. Left sides of the plurality of display cabinets 2 located between the locker 1 and the last display cabinet 2 define the sixth opening 24 corresponding to the fourth opening 23. The left side of the last cabinet 2 does not define the sixth opening 24, thus the display product in the last cabinet 2 can be avoided to lose.

Figure 12:
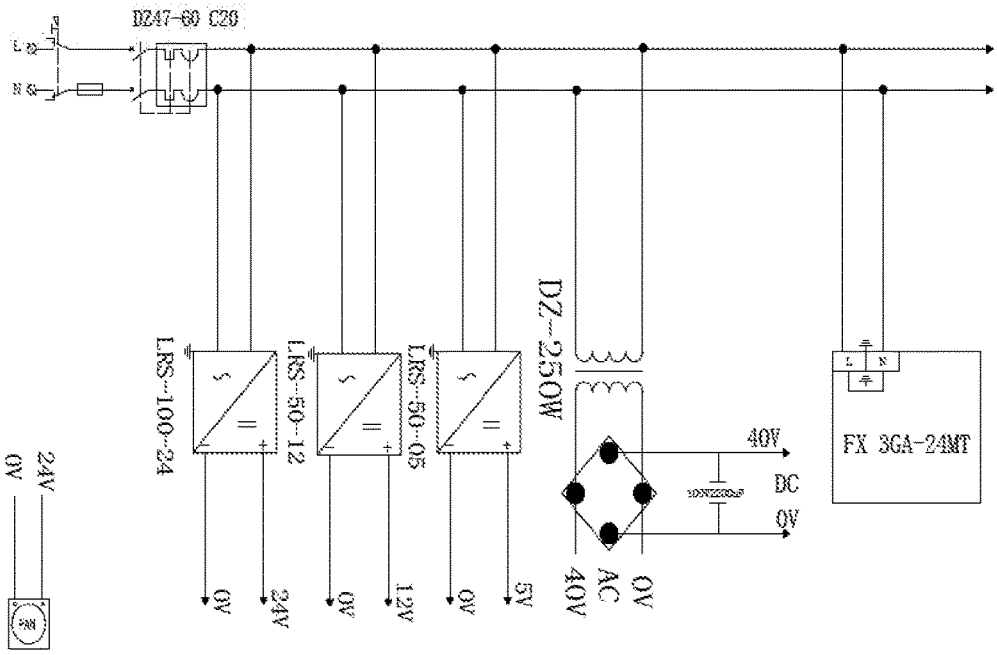
FIG. 12 is a block diagram of an electrical circuit of a display cabinet according to one embodiment.
Figure 13:
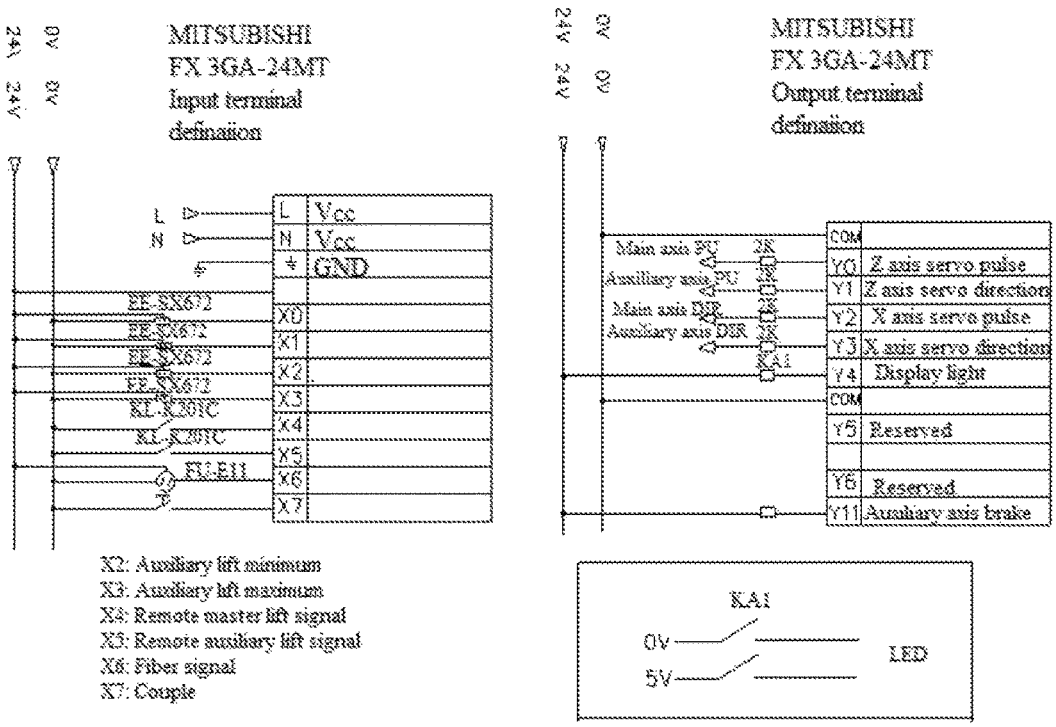
FIG. 13 is a wiring diagram of a PLC according to one embodiment.

FIGS. 12-13 show a control method of the display apparatus which is an automatic back library, anti-theft, anti-destruction display apparatus. The control method can comprise a plurality of steps as below:

In step S101, Writing a program into the PLC system to determine a display time of the display product, a control manner on the mobile terminal is switched to an automatic mode, when a display opening button is triggered, the first telescopic bracket 120 drives the supporting board to move to the first roller drive assembly 111. The first telescopic bracket 120 retracts away from one side of the first roller drive assembly 111, the supporting board 13 and the display cabinet 2 fall to the upper side of the first roller drive assembly 111. The first roller drive assembly 111 transmits the supporting board 13 with the display product to the display cabinet 2. The shatter door 261 is rolled over by the pulley block 262, and the LEDs are lighted. The second telescopic bracket 220 extends to lace the second roller drive assembly 211 under the supporting board 13. The second electrical lifting assembly 221 drives the second telescopic bracket to lift to the fifth opening 25 with the supporting board 13.

In step S102: When the display time is over, the second electrical lifting assembly 221 drives the second telescopic bracket 220 to move downward with the supporting board 13. The second telescopic bracket 220 retracts away from the second roller drive assembly 211 and the supporting board 13 falls to the upper side of the second roller drive assembly 211. The LEDs are turned off and the shutter door 261 is turned off. The second roller drive assembly 211 transmits the supporting board 13 with the display product to the locker 1.

In step S103, the control manner on the mobile terminal is switched to a manual mode, and a transmitting button is triggered, the first roller drive assembly 111 transmits the supporting board 13 with the display product to the display cabinet 2. The shutter door 161 is rolled over by the pulley block 162, and the LEDs are lighted. The second telescopic bracket 220 extends to face the second roller drive assembly 211 under the supporting board 13. The second electrical lilting assembly 221 drives the second telescopic bracket 220 with the supporting board 13 to lift to the fifth opening 25.

In step S104, When a gate control button is triggered, the glass is fell down by the third electrical lifting assembly 272, the display product in the display cabinet 2 is changed. After the display product is changed, the gate control button is triggered again; the glass is lifted up by the third electrical, lifting assembly 272.

In step S105, When an automation button is triggered, the display product can be moved back and forth between tire locker 1 and the display cabinet 2 according to the display time. When the display cabinet 2 is destroyed, the display cabinet 2 generates a vibration; the alarming system generates a ring. The LEDs and the shutter door are turned off. The second roller drive assembly 211 transmits the supporting board 13 with the display product to the locker 1.

The mobile terminal can couple with the display apparatus via a mobile communication system, such as WIFI, GPRS, LTE communication system.

The mobile terminal can be remotely controlled by a cell phone. And the locker 1 and the display cabinet 2 are controlled by the mobile terminal.

Third Embodiment

Figure 4:
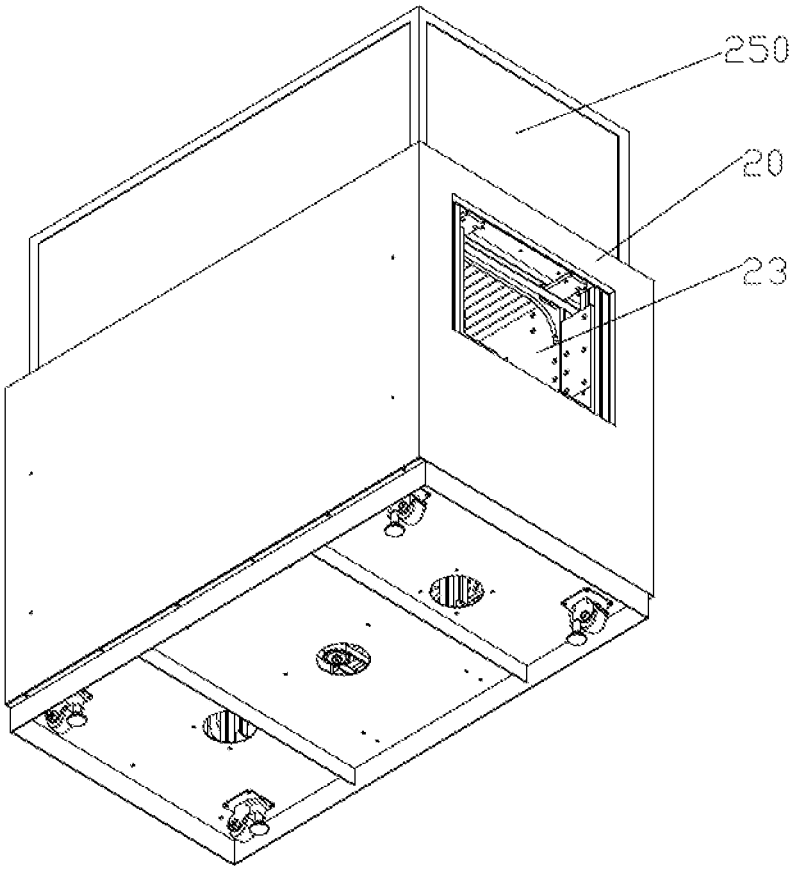
FIG. 4 is schematic view of a display cabinet of the display cabinet.
Figure 5:
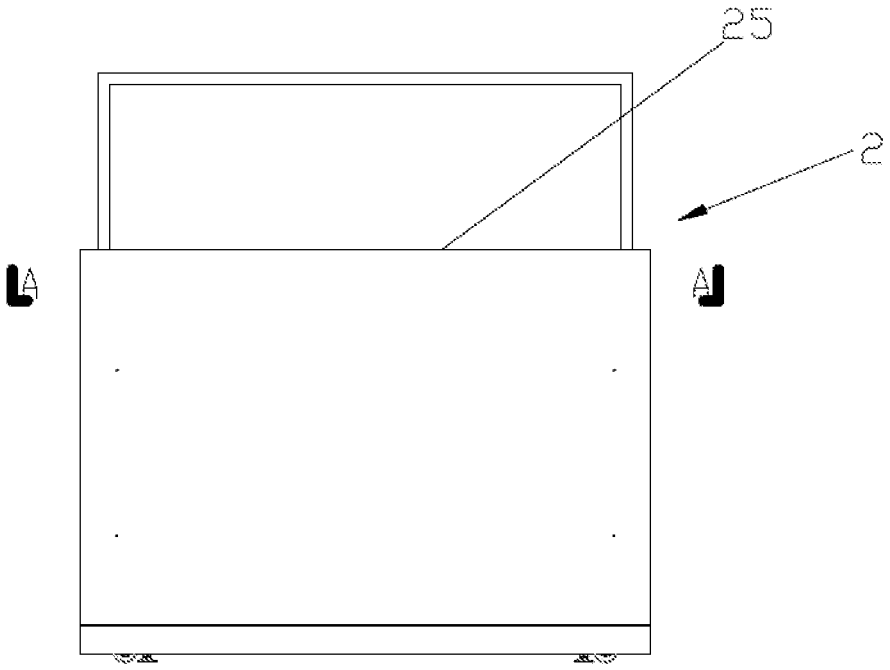
FIG. 5 is a front view of the display cabinet of FIG. 4.

Referring to FIGS. 4-5, a display apparatus is provided in the present disclosure. The display apparatus is an automatic back library, anti-theft, anti-destruction display apparatus. The display apparatus can includes a display cabinet 2 which includes a display cabinet body 20. A fourth opening 23 is defined in the right side of the display cabinet body 20; a fifth opening 25 is defined in the upper side of the display cabinet body 20. A display window 250 is arranged on the fifth opening 25. The display product can be placed into the display cabinet body 20 via the fourth opening 23 or the fifth opening 25. When the display product is needed to change, the display product can be changed via opening the fourth opening 23 or the fifth opening 25. The visitors can see the display product in the display cabinet body 20 via the display window 250.

Fourth Embodiment

Referring to FIGS. 4-5, a display apparatus is provided in the present disclosure. The display apparatus is an automatic back library, anti-theft, anti-destruction display apparatus. The display apparatus can includes a display cabinet 2 which includes a display cabinet body 20, a second transmission structure 21 and a second lifting telescopic structure 22. Anti-destruction display windows are arranged on a left, right, front and hack sides of the display cabinet body 20. A top plate of the display cabinet body 20 is not transparent, a material and color of the top plate is the same with a material and color of the display cabinet body 20. The second transmission structure 21 and the second lifting telescopic structure 22 are mounted in the display cabinet body 20, and the second lifting telescopic structure 22 is on the second transmission structure 21.

The PLC system is arranged in the locker 1. The PLC system is in control connection with the second transmission structure 21, the lifting telescopic structure 22.

In the embodiment, the control connection denotes feat the second transmission structure 21 and the second lifting telescopic structure 22 are controlled by a control program of the PLC system. In the embodiment, the PLC system is controlled by the mobile terminal via a wireless signal.

As shown in FIG. 6, the display cabinet 2 can further include a display bracket, an LED bracket, a load plate, a glass lifting structure 27, a shutter lifting structure 26, and an alarming system. The display bracket is mounted in the display cabinet body 20. The LED bracket is mounted in the display window 250. The load plate is mounted in a lower side of the display cabinet body 20. An omni-directional wheel is arranged under the load plate. The second transmission structure 21 is mounted in the display bracket. The second lifting telescopic structure 22 is mounted in the display bracket and located on the second transmission structure 21. The shutter lilting structure 26 is vertically mounted on the second transmission structure 21 and the display bracket. The glass lifting structure 27 is mounted in a front side between the display cabinet body and the second lifting telescopic structure 22.

A plurality of LEDs are arranged on the LED bracket to light the display product. The glass lilting structure 27 and the shutter lifting structure 26 are configured to protect the display product. When the display cabinet 1 is destroyed, the alarming system generates a vibration and a ring and the PLC system receives an alarming signal. The supporting board 13 with the display product falling down to the display cabinet body 20 by the second transmission structure 21 and the second lifting telescopic structure 22 under a control of the PLC system. When the display cabinet 2 is not displayed, the display window and the display product are received in the display cabinet body 20. When the display product is needed to display, the PLC System controls the second transmission structure 21 and the second lifting telescopic structure 22 to lift the display product with the display window.

Although the features and elements of the present disclosure are described as embodiments in particular combinations, each feature or element can be used alone or in other various combinations within the principles of the present disclosure to the fall extent indicated by the broad general meaning of the terms in which the appended claims are expressed.

What is claimed is:

1. A display apparatus, comprising:

a locker comprising: a locker body, a first transmission structure, a first lifting telescopic structure, and a supporting board; a first opening defined in a left side of the locker body, a second opening defined in a right side of the locker body, a third opening defined in an upper side of the locker body; the first transmission structure mounted in the locker body and located between the first opening and the second opening; the first lifting telescopic structure mounted in the locker body and located on the first transmission structure; the supporting board mounted on the first lifting telescopic structure;

at least one display cabinet, each display cabinet comprising: a display cabinet body, a second transmission structure, and a second lifting telescopic structure; a fourth opening defined in a right side of the display cabinet body corresponding to the first opening, a fifth opening defined in an upper side of the display cabinet body, an anti-destruction display window arranged on the fifth opening; the second transmission structure mounted in the display cabinet body, the second lifting telescopic structure mounted in the display cabinet body and located on the second transmission structure, and a number of the supporting board greater than or equal to a number of the display cabinet;

a rail arranged between the fourth opening and the first opening to connect the first transmission structure and the second transmission structure;

a programmable logic controller system mounted in the locker and in control connection with the first transmission structure, the first lifting telescopic structure, the second transmission structure, and the second lifting telescopic structure.

2. The display apparatus of claim 1, wherein the locker comprises a locker bracket, a wall board, an electrical cabinet, and a wall-through interface; the locker bracket is mounted in the locker body, the wall board is arranged on a front and back sides of the locker body to fix the first transmission structure and the first lifting telescopic structure; the electrical cabinet is mounted in the locker bracket; the programmable logic controller system is mounted in the electrical cabinet.

3. The display apparatus of claim 2, wherein the first transmission structure comprises a first transmission bracket and a first roller drive assembly; the first roller drive assembly is mounted on the first transmission bracket; the first lifting telescopic structure comprises a first telescopic bracket and a first electrical lifting assembly, the first telescopic bracket is mounted on the first electrical lifting assembly and driven to move upward and downward by the first electrical lifting assembly, the supporting board is mounted on the first telescopic bracket.

4. The display apparatus of claim 3, wherein the display cabinet comprises a display bracket, an LED bracket, a load plate, a glass lifting structure, a shutter lifting structure and an alarming; the display bracket is mounted in the display cabinet body, the LED bracket is mounted in the display window, the LED bracket is in control connection with the programmable logic controller system; the load plate is mounted under the display cabinet body, an omni-directional wheel is arranged under the load plate; the second transmission structure is mounted in the display bracket, the second lifting telescopic structure is mounted in the display bracket and located on the second transmission structure; the shutter lifting structure is in control connection with the programmable logic controller system, the glass lifting structure is mounted between the display cabinet body and the second lifting telescopic structure and located in a front side of the lifting telescopic structure, the glass lifting structure is in control connection with the programmable logic controller system, the alarming system is mounted in the display cabinet body and in control connection with the programmable logic controller system.

5. The display apparatus of claim 4, wherein the second transmission structure comprises a second transmission bracket, a second roller drive assembly mounted on the second transmission bracket; the second lifting telescopic structure comprises a second telescopic bracket and a second electrical lifting assembly, the second telescopic bracket is mounted on the second electrical lifting assembly and driven to move upward and downward by the second electrical lifting assembly.

6. The display apparatus of claim 5, wherein the shutter lifting comprises a fixing bracket, a shutter door and an electrical pulley block, the shutter door is mounted on the fixing bracket; the electrical pulley block is coupled to the shutter door via the fixing bracket.

7. The display apparatus of claim 6, wherein the glass lifting structure comprises a second fixing bracket, an third electrical lifting assembly, and a glass; the third electrical lifting assembly is mounted on the second fixing bracket, the glass is mounted on the third electrical lifting assembly.

8. The display apparatus of claim 1, wherein a sixth opening defined in a left side of the display cabinet, a size of the sixth opening is the same with a size of the fourth opening.

9. A control method of a display apparatus of claim 7, a programmable logic controller system of the display apparatus coupled to a mobile terminal, the control method comprising:

writing a program into the programmable logic controller system to determine a display time of the display product, a control manner on the mobile terminal switched to an automatic mode, wherein when a display opening button is triggered, the first telescopic bracket drives the supporting board to move to the first roller drive assembly, the first telescopic bracket retracts away from one side of the first roller drive assembly, the supporting board and the display cabinet fall to the upper side of the first roller drive assembly; the first roller drive assembly transmits the supporting board with the display product to the display cabinet; and the shutter door is rolled over by the pulley block, and the LEDs are lighted, the second telescopic bracket extends to face the second roller drive assembly under the supporting board, the second electrical lifting assembly drives the second telescopic bracket to lift to the fifth opening with the supporting board.

10. The control method of claim 9, wherein when the display time is over, the second electrical lifting assembly drives the second telescopic bracket to move downward with the supporting board, the second telescopic bracket retracts away from the second roller drive assembly, and the supporting board falls to the upper side of the second roller drive assembly, and the LEDs are turned off and the shutter door is turned off the second roller drive assembly transmits the supporting board with the display product to the locker.

11. The control method of claim 10, wherein the control manner on the mobile terminal is switched to a manual mode, and a transmitting button is triggered, the first roller drive assembly transmits the supporting board with the display product to the display cabinet, the shutter door is rolled over by the pulley block, and the LEDs are lighted, and the second telescopic bracket extends to face the second roller drive assembly under the supporting board, the second electrical lifting assembly drives the second telescopic bracket with the supporting board to lift to the fifth opening.

12. The control method of claim 11, wherein when a gate control button is triggered, the glass is fell down by the third electrical lifting assembly, the display product in the display cabinet is changed, after the display product is changed, the gate control button is triggered again, the glass is lifted up by the third electrical lifting assembly.

13. The control method of claim 12, wherein when an automation button is triggered, the display product can be moved back and forth between the locker and the display cabinet according to the display time, when the display cabinet is destroyed, the display cabinet generates a vibration, the alarming system generates a ring, and the LEDs and the shutter door are turned off, the second roller drive assembly transmits the supporting board with the display product to the locker.

14. The control method of claim 11, wherein the mobile terminal couples with the display apparatus via a mobile communication system, and the mobile terminal is remotely controlled by a cell phone.

* * * * *